US006839305B2

(12) United States Patent
Perlman et al.

(10) Patent No.: US 6,839,305 B2
(45) Date of Patent: Jan. 4, 2005

(54) HABIT CESSATION AIDE

(76) Inventors: Neil Perlman, 35 Coldstream Cir., Lincolnshire, IL (US) 60069; Daniel Mapes-Riordan, 1433 Judson Ave., Evanston, IL (US) 60201

( * ) Notice: Subject to any disclaimer, the term of this patent is extended or adjusted under 35 U.S.C. 154(b) by 201 days.

(21) Appl. No.: 09/788,134

(22) Filed: Feb. 16, 2001

(65) Prior Publication Data

US 2002/0114223 A1 Aug. 22, 2002

(51) Int. Cl.[7] ..... G04F 10/00; G04B 47/00; G04B 19/00; A24F 47/00

(52) U.S. Cl. ..... 368/109; 368/10; 368/223; 368/278; 131/270

(58) Field of Search ..... 131/270; 368/10, 368/281–282, 278, 223, 228, 107–113

(56) References Cited

U.S. PATENT DOCUMENTS 4,630,935 A * 12/1986 Zettek ..... 368/41
4,853,854 A * 8/1989 Behar ..... 700/295
5,285,430 A * 2/1994 Decker ..... 368/281
5,813,026 A * 9/1998 Borg ..... 711/115
5,861,797 A * 1/1999 Becker ..... 340/309.3
6,305,839 B1 * 10/2001 Krstulovic ..... 368/281

* cited by examiner

*Primary Examiner*—David Martin
*Assistant Examiner*—Michael L. Lindinger

(57) ABSTRACT

A habit cessation aide includes a timer to determine the interval between starting a habitual act, a display for displaying messages in operative connection to the timer, and a strap for securing to a user's body. A widely held habit is smoking, for which the illustrated embodiment is directed towards. The habit cessation device also includes an alarm, which may be auditory, vibratory, or a combination. As shown, the device is in the form of a wristwatch and also functions as a standard wristwatch and includes features such as calculating and displaying items including at least time, date, and elapsed time. Depending upon the frequency of cigarette smoking, signaled by the push of a specialized button, different messages are displayed, such as encouraging, statistical or informational, to help the user quit the habit.

6 Claims, 6 Drawing Sheets

HABIT CESSATION AIDE

BACKGROUND OF THE INVENTION

This device relates to the habit devices generally, and more particularly to a habit cessation aide, such as a smoking cessation aide.

Approximately 25% of the American population currently smokes. Smoking contributes to numerous medical problems and an early death in approximately one-third of smokers. Because smoking is very addictive, most smoking cessation methods have poor success rates. Studies have shown that nicotine patches, gum and sprays have a 25%–58% short-term success rate and only a 11%–28% one year success rate. According to published studies, the anti-smoking prescription medication Bupropion (Zyban) has a 55% success rate when combined with smoking cessation therapy, and 20% short-term success rate without therapy. Various other methods, including medications, acupuncture, hypnosis, counseling, ear bands, etc., have also been utilized without substantial success. A principal reason for the low success rates is that people wanting to quit smoking often need regular positive and negative reinforcement that the above methods and devices cannot provide.

Other habits may be broken with the advantage of regular reinforcement.

SUMMARY OF THE INVENTION

A primary object of the present invention is to provide reinforcement to help a smoker quit smoking.

A related object of the present invention is to provide periodic reinforcement to help users with a repetitive habit quit that habit.

Another object of the present invention is to provide a smoking cessation aide that is convenient and less disruptive to users.

In accordance with a preferred embodiment of the present invention a habit cessation aide comprises a timer to determine the interval between starting a habitual act, a display for displaying messages in operative connection to the timer, and a strap for securing to a user's body.

In the preferred embodiment, the habit is smoking. The smoking cessation aide of the preferred embodiment of the present invention appears similar to a standard watch. Besides having a standard display and two side buttons, it has a "cigarette" button on the face. The cigarette button and the programming inside the watch track cigarette smoking. The user is simply required to tap the cigarette button at the onset of starting each tobacco product. By utilizing positive and negative feedback, the user is encouraged to diminish and eventually quit their tobacco habit. The cessation aide utilizes various displays, messages, auditory and vibratory alarms to provide feedback.

Other objects and advantages of the habit cessation aide will become apparent from the following descriptions, taken in connection with the accompanying drawings, wherein, by way of illustration and example, an embodiment of the present invention is disclosed.

BRIEF DESCRIPTION OF THE SEVERAL VIEWS OF THE DRAWINGS

The drawings constitute a part of this specification and include exemplary embodiments to the invention, which may be embodied in various forms. It is to be understood that in some instances various aspects of the invention may be shown exaggerated or enlarged to facilitate an understanding of the invention.

DETAILED DESCRIPTION OF THE PREFERRED EMBODIMENTS

Detailed descriptions of the preferred embodiment are provided herein. It is to be understood, however, that the present invention may be embodied in various forms. Various aspects of the invention may be inverted, or changed in reference to specific part shape and detail, part location, or part composition. Therefore, specific details disclosed herein are not to be interpreted as limiting, but rather as a basis for the claims and as a representative basis for teaching one skilled in the art to employ the present invention in virtually any appropriately detailed system, structure or manner.

Figure 1:
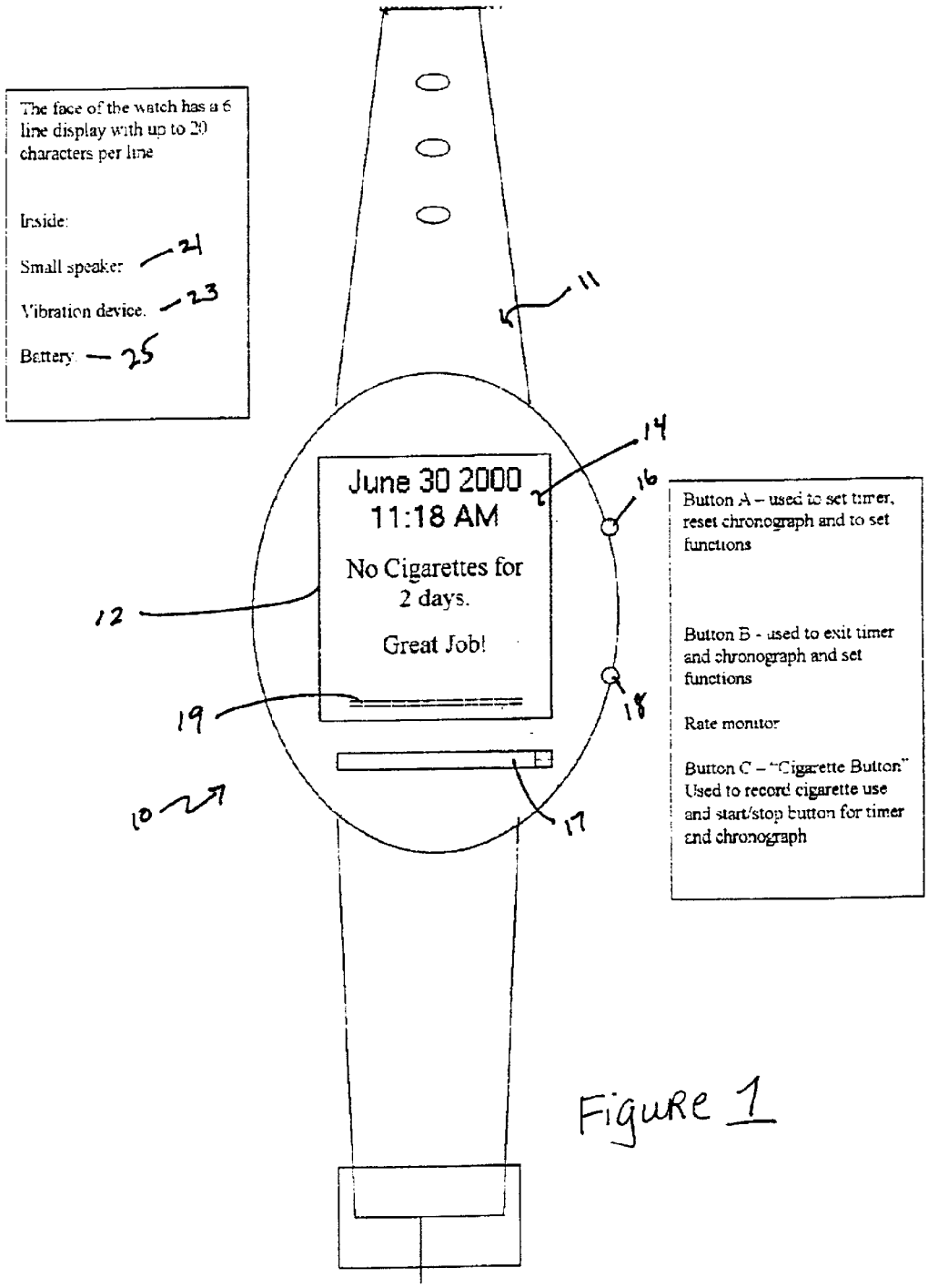
FIG. 1 is a perspective view of the smoking cessation aide in accordance with a preferred embodiment of the present invention and is shown in the form of a wristwatch.

In accordance with the preferred embodiment of the present invention and as shown in FIG. 1, the invention takes the form of an ordinary wristwatch 10. The watch display 12 can show multiple lines of text 14, and may be of the LED, LCD, or other appropriate construction, and is shown with six lines of display. In the illustrated form, there are three input buttons: two are on the side of the watch 16, 18, and one on the clock face, shaped like a cigarette 17. Normally, the watch may display the time, date, and a cigarette message in display 12. The message may change, for example, every 20 seconds. It may display in sequence the total number of cigarettes of the day, the time since the user smoked the most recent cigarette, a supportive message, a combination thereof, or any other appropriate display. The aide may be programmed so that, for example, every 10 minutes throughout the day, the watch will display different encouraging messages to help decrease the desire to smoke. These messages may be customized to be more encouraging with a fast rate of decline of smoking or more empathetic if the rate is slow. When no cigarettes have been smoked, for example, the watch may be programmed to display the number of days of abstinence and a different congratulatory message about the achievement or the health benefits. In addition, there is a cigarette rate monitor 19 displayed above cigarette button 17 that shows when an adequate time has passed between the last cigarette.

It will be appreciated that the illustrated form is a wristwatch, but the invention may take any appropriate form such as a separately accessed unit not attached to the user.

In operation, the user taps the "cigarette button" 17 at the onset of lighting a cigarette. The program in watch 10 may keep track of the number of cigarettes smoked per day. It may also calculate and keep track of the average time between cigarettes per day. An auditory 21 and/or vibratory 23 cigarette alarm, such as incorporated in many small pager devices, incorporated herein by reference, may also go off signaling the user to put the cigarette out early. To increase the effectiveness of the alarm, it can be programmed to not occur all of the time, or at random intervals after initiating lighting a cigarette. For example, the alarm will occur 30% of the time when less then 10 cigarettes are smoked and increase in frequency as more cigarettes are smoked in a day. In an exemplary embodiment, the user can set the alarm to be vibratory, auditory, both, or random. The programming required to perform these tasks is enclosed inside the watch and described in connection with FIGS. 2 through 6, below.

At the beginning of every day, the user will be asked to tap cigarette button 17. This ensures that the watch is being utilized and helps in the calculations for a periodic interval such as a 24 hour day, though any appropriate interval may be used, depending upon the habit wanted to stop.

The device can also be used as an alarm clock, timer or chronograph, and uses a standard watch battery 25, or other suitable battery, for power, as many wristwatches and hand-held devices on the market, incorporated herein by reference. A wrist strap 11 is adjustable for standard wrist sizes and the watch may come in different colors and materials.

Figure 2:
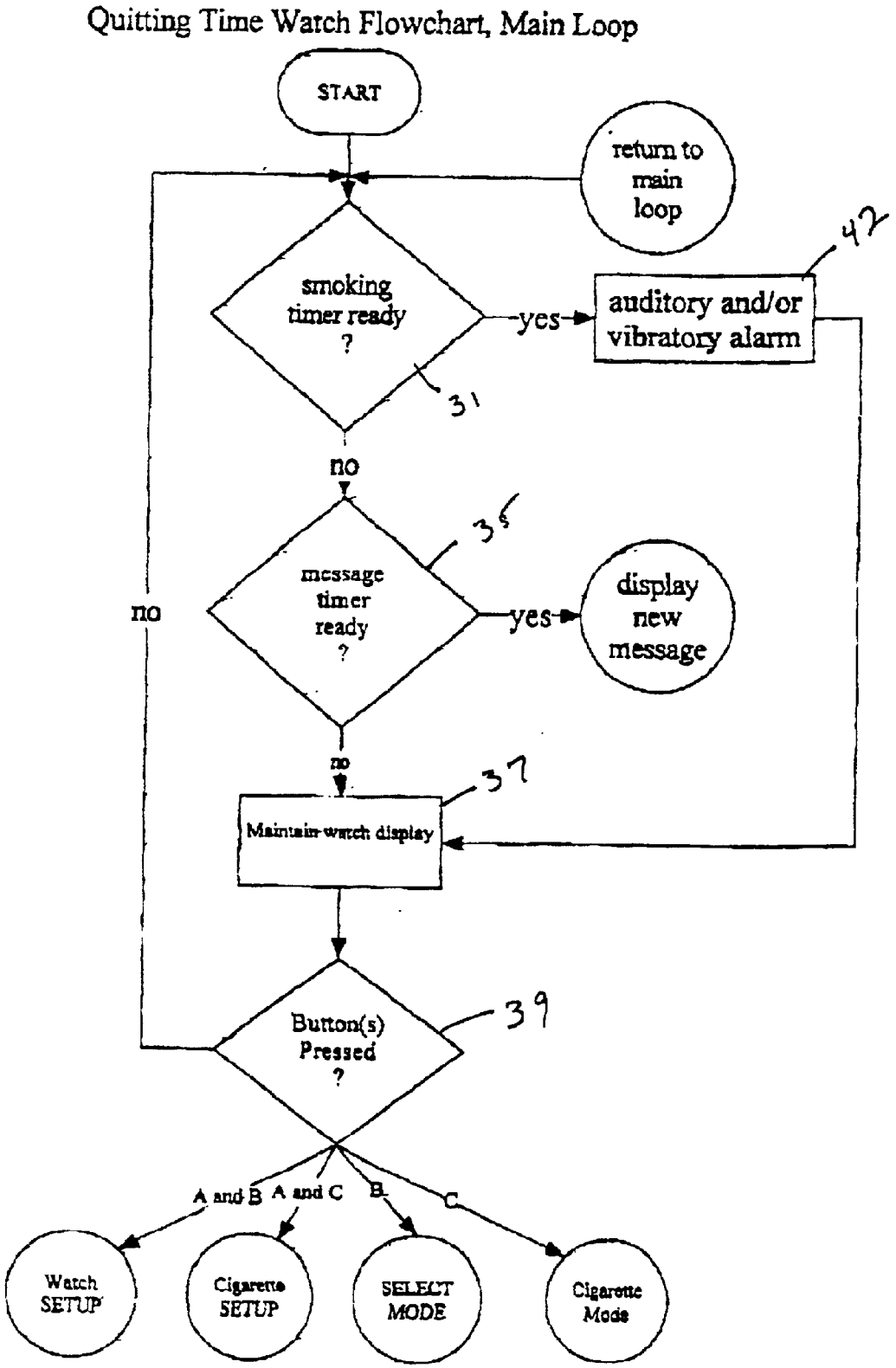
FIG. 2 is a flow diagram of the main loop of the program of the illustrated embodiment of the present invention.

The flowchart of FIG. 2 illustrates the main loop of the program imbedded in the habit cessation aide. In general, and in the illustrated embodiment, the main loop checks the status of smoking timer 31 and message timer 35, determines if a button has been pressed at 39, and maintains the watch display 12 at step 37. Alternatively, the device could use wait and interrupt structure to process timers, displays, and button presses instead of the illustrated interrupt polling structure.

In the illustrated embodiment, watch display 12 includes at least three sub-displays: the current time and date, the message display, and the rate monitor display. The current time and date display are self-explanatory and display the current time and date as is customary in many displays. The message display as described in more detail in connection with FIG. 3 may display current smoking frequency statistics or display encouraging messages.

Rate monitor display 19 provides a continual graphical representation of the current time since the last cigarette has been smoked. In the preferred embodiment, rate monitor 19 is a red and green horizontal bar whose total length represents the time between cigarettes needed to decrease the current average amount of cigarettes consumed each day by a predetermined percentage. For example, as the user decreases their rate of smoking, the length of the bar represents a longer period of time to encourage the user to continue to decrease their rate of smoking; as the time since the last cigarette increases, the length of the red section of the bar increases from left to right. When the length of the red bar reaches a length corresponding to a decrease in daily smoking rate by the predetermined percentage, further increases in the bar length are changed to the color green indicating that the duration between cigarettes has been long enough to decrease the rate of smoking. At a selected interval, approximately 5–10 minutes, for example, after the cigarette button has been pressed, the rate monitor bar size resets and the process repeats. The exact amount depends on their current daily smoking rate.

Turning again to FIG. 2 and particularly block 31, when the smoking timer is has counted down to zero the watch will issue a short auditory, vibratory or combination alarm 42 specified by the user in the setup mode, as described below in connection with FIG. 5. The function of the cigarette alarm 42 is to remind the user to extinguish the cigarette. Alarm 42 is randomly selected to go off while a person is in the act of smoking, and in the preferred embodiment, the odds of going off is programmed to be low during the first set of cigarettes smoked during the day. For example, during the first five cigarettes smoked during a day the alarm may only go off ten percent of the time. These odds gradually increase with the number of cigarettes smoked during the day until it reaches a maximum (e.g. up to 75% of the time for cigarettes numbered twenty and over). The time that cigarette alarm 42 goes off while the person is smoking can be randomly varied within a predetermined time interval, for example, between 30 and 90 seconds.

Figure 3:
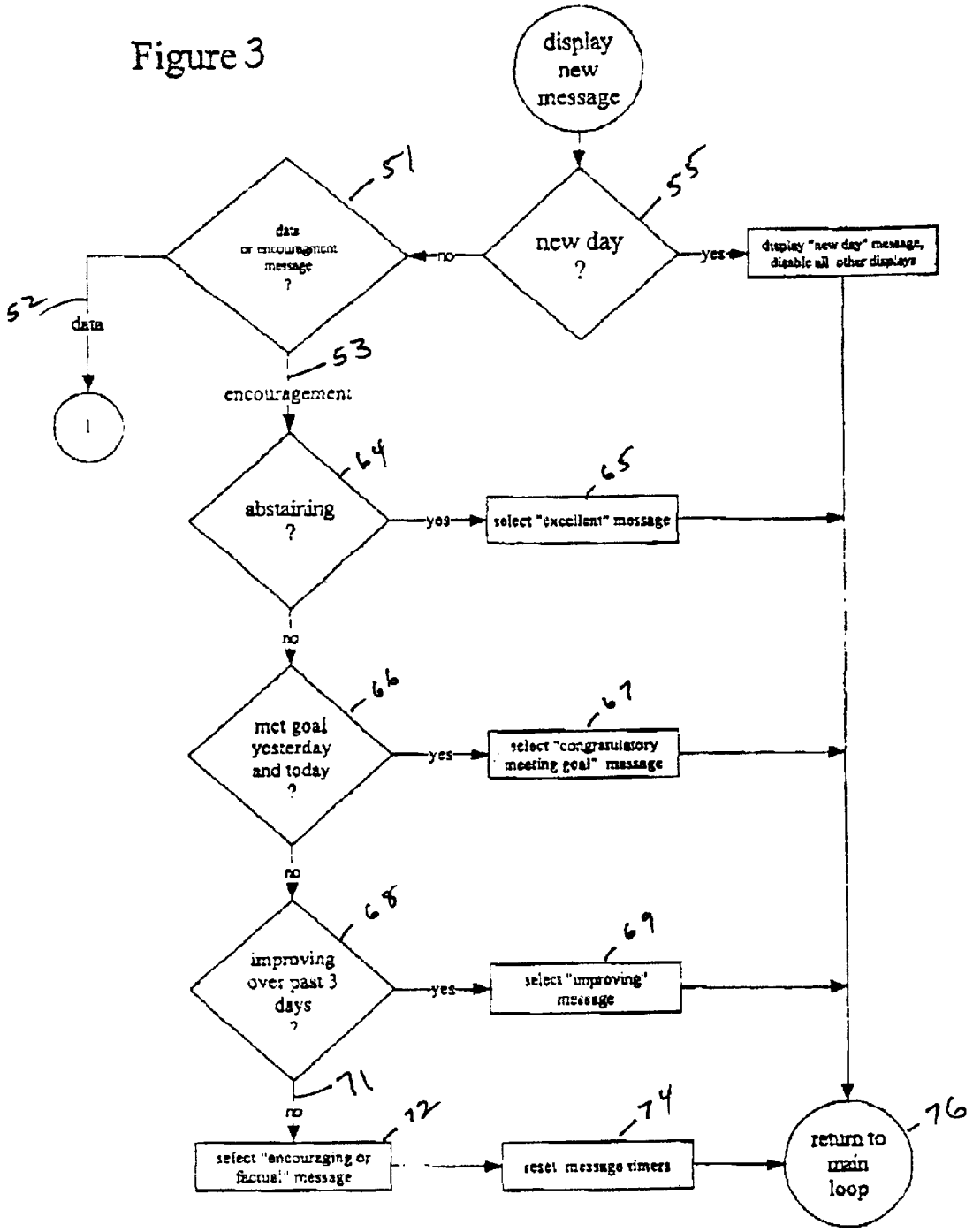
FIG. 3 is a flow diagram of a portion of the program to display a new message on the wristwatch face in accordance with the flow diagram of FIG. 2.
Figure 3:
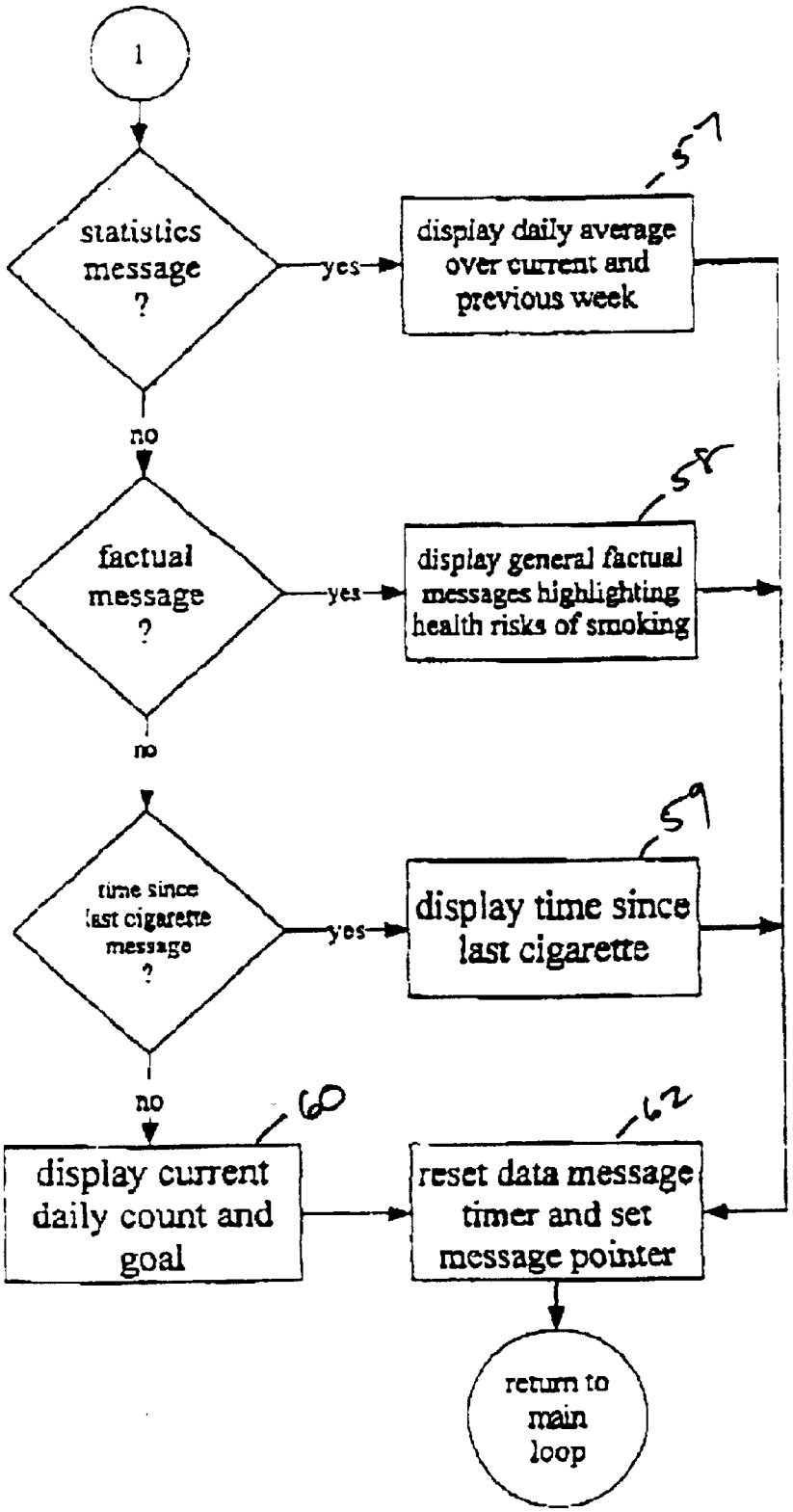

The habit cessation aide 10 will display a new message when message timer 35 has counted down to zero. As illustrated in FIG. 3, there are two primary categories of messages 51, "data" messages 52 and "encouragement" messages 53. In addition, "new day" message 55 is displayed at the beginning of each day to reset the cigarette counters and flags as described in Cigarette button 17 action of FIG. 6. In the embodiment shown, there are four different data messages 52. One message displays the average daily number of cigarettes smoked during the current day 57. Each message 57, 58, 59, and 60 is displayed for approximately one minute in the preferred embodiment. The four messages continually cycle through display 12. This is accomplished using the data message timer and pointer 62. When data message timer 62 counts to zero the message pointer is set to point to the next message and the timer is reset. A data message can be overwritten by an "encouragement" message as described below.

The primary type of "encouragement" message 53 displayed depends on how well the smoker has reduced their daily intake of cigarettes. The actual message displayed may be randomly selected from of subset of messages depending on the overall progress made in reducing the frequency of smoking. If the user has not smoked any cigarettes in the past predetermined number of days, that is, the user is completely abstaining from smoking 64, a message indicating their "excellent" progress 65 may be displayed. If the user has not been abstaining from smoking, yet has met their goal of reducing the daily number of cigarettes 66 they normally smoke over the past two days, a "congratulatory" message 67 may be displayed indicating that they are meeting their goal. If they haven't met their goal yet have still reduced the daily number of cigarettes over the past three days 68, then an "improving" message 69 may be displayed to encourage the user to continue reducing their daily cigarette count. If the user has not shown any improvement over the past three days 71, an "encouraging" message is displayed in an attempt to get them started in reducing their frequency of smoking, or, alternatively, a factual message could be displayed reminding them of the dangers of smoking 72. Once the proper message to display has been determined, the encouragement message timer is randomly reset at step 74 to a value, for example, between five and twenty-five minutes, before returning to the main loop 76.

Setup button 18 changes the mode of the watch to include functions typically included in digital watches, such as stopwatch, alarm, etc.

Figure 4:
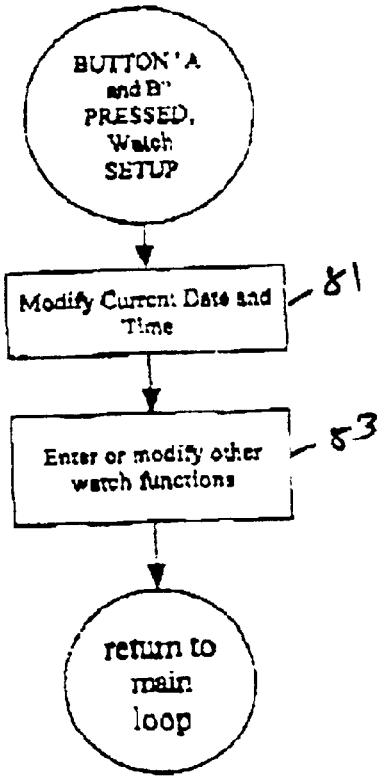
FIG. 4 is a flow diagram of the watch set up mode of FIG. 2.
Figure 5:
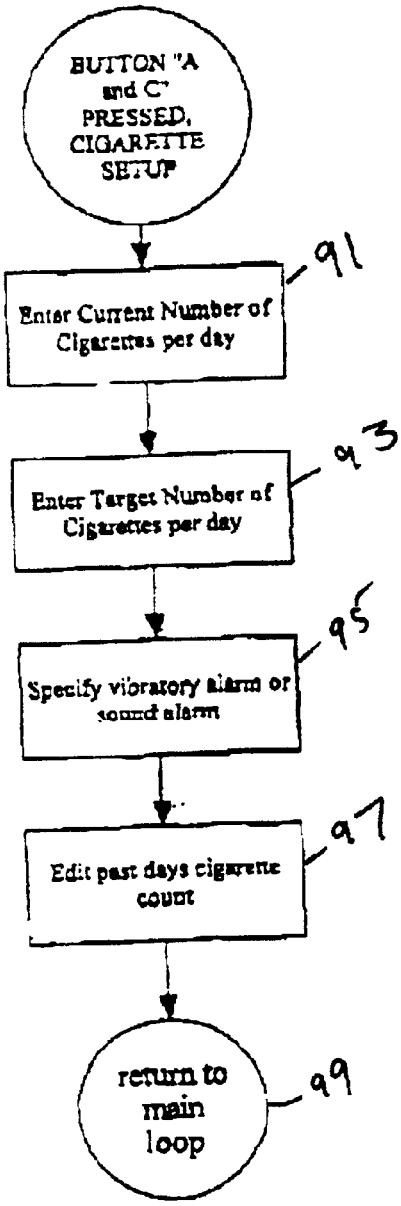
FIG. 5 is a flow diagram of the cigarette setup mode of FIG. 2.

As illustrated in FIGS. 4 and 5, pressing Setup button 18 in combination with either Mode button 16 or Cigarette button 17 allows users to view and edit various features of the watch. While in the "Watch Setup" mode as show in FIG. 4, continually pressing Setup button 18 scrolls through the various parameters that can be edited. For example, current date and time 81, alarm settings 83, etc. can be set. While in the "Cigarette Setup" mode as shown in FIG. 5, continually pressing Setup button 18 scrolls through the various cigarette parameters that can be edited. For example, the initial number of cigarettes smoked each day can be specified at step 91, the target number of cigarettes for the day may be set at step 93, and the "smoking" alarm can be specified as vibratory, auditory, both vibratory and auditory, or no alarm at step 95. In addition, a specific previous daily cigarette count can be edited 97. This feature allows users to manually enter the number of cigarettes smoked during a specific day in the event they miss a day, or forget to count a certain number of cigarettes during a day. This also allows users to correct times when they forget to use the device, or in the illustrated embodiment, wear their watch. The watch returns to the main loop after scrolling through the various editable parameters at step 99.

Figure 6:
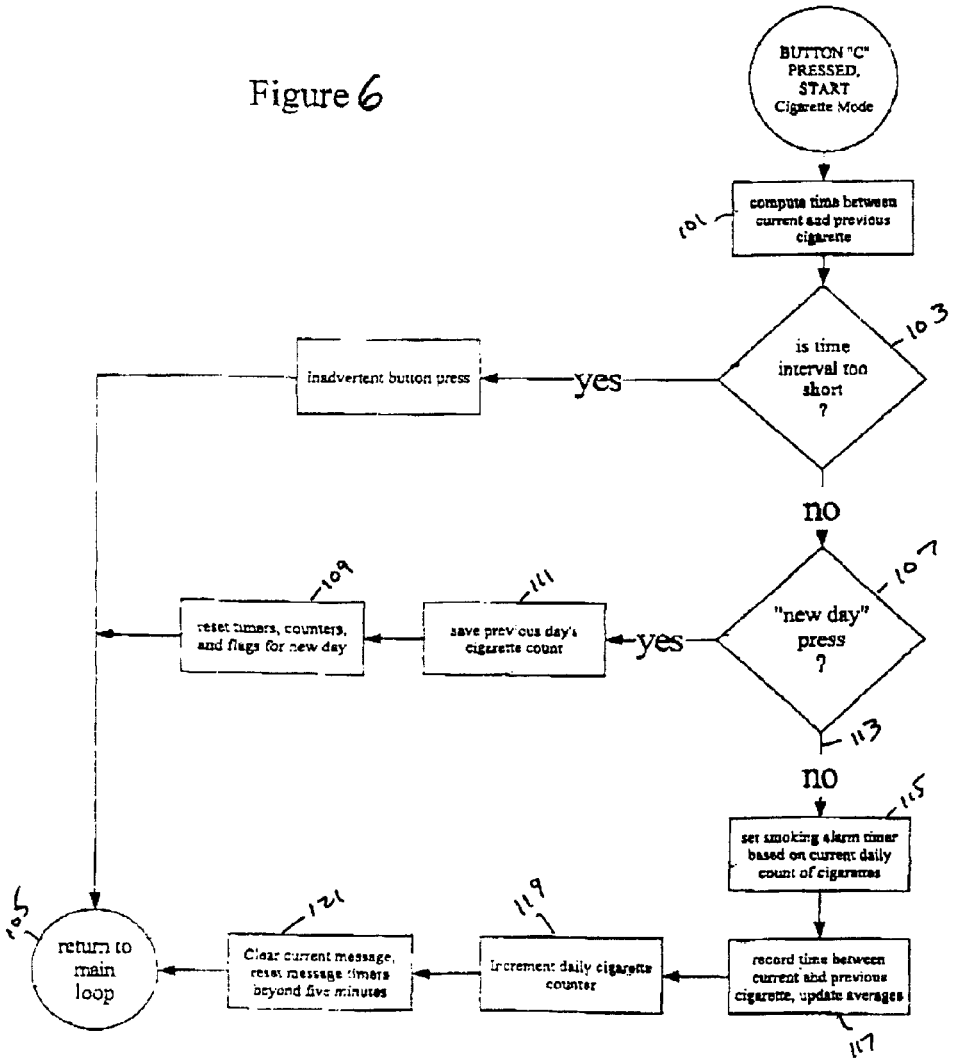
FIG. 6 is a flow diagram of the cigarette mode of FIG. 2.

The purpose of cigarette button 17 is to count the number of cigarettes the user smokes. The user is instructed to press this button every time they light up a cigarette. This data in conjunction with a clock is necessary to calculate the desired data values and statistics. The accuracy of the obtained data is dependent on the user faithfully pressing the button when every cigarette is lit. As illustrated in FIG. 6, the first value computed is the time between the current and the previous cigarette button press 101. If the time between presses is too short, as determined at step 103, e.g., less than one minute, the program returns to the main loop 105. This guards against inadvertent button presses and acts as a button press "debouncer." If the cigarette button was pressed because the display prompted the user to initiate a new day of use 107, the message timers and flags are reset at step 109, and the previous day's cigarette counter is stored for that day and then reset, step 111. If the button press indicates that the user has begun to smoke a cigarette 113, the smoking alarm timer is set based on the current daily count of cigarettes smoked 115, as described above. In addition, the time between the current and previous cigarette is calculated and used to update the associated average statistics at step 117, the daily cigarette counter is incremented 119, and the current message is cleared and subsequent messages are suppressed by setting the message timers 121 for a period of approximately 5–10 minutes.

While the invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined by the appended claims.

What is claimed is:

1. A habit cessation aide comprising:

a timer assembly to detect the times a habit occurs in a pre-established historical period, and the time the habit most recently occurred, a first display section for displaying messages, such messages not to include a message that the habit can or should be performed, in operative connection to the timer assembly; and a second display section for displaying a relative length of time since the most recent occurrence of the habit.

2. A habit cessation aide as claimed in claim 1 wherein the habit is smoking.

3. A habit cessation aide as claimed in claim 1 further comprising an alarm.

4. A habit cessation aide as claimed in claim 3 wherein the alarm is selected from the group consisting of auditory and vibratory.

5. A habit cessation aide as claimed in claim 1 wherein the aide is in the form of a wristwatch.

6. A habit cessation aide as claimed in claim 1 further comprising:

a means for functioning as a wristwatch and displaying items including at least time, date, elapsed time.

* * * * *